United States Patent [19]

Ritter et al.

[11] Patent Number: 4,779,577

[45] Date of Patent: Oct. 25, 1988

[54] COOLING AIR FLAP AND BLOWER CONTROL FOR MOTOR VEHICLES

[75] Inventors: Bernhard Ritter, Pforzheim-Eutingen; Hermann Burst, Rutesheim; Ulrich Schempp, Tiefenbronn, all of Fed. Rep. of Germany

[73] Assignee: Dr. Ing.h.c.F. Porsche Aktiengesellschaft, Stuttgart, Fed. Rep. of Germany

[21] Appl. No.: 937,022

[22] Filed: Dec. 2, 1986

[30] Foreign Application Priority Data

Jul. 26, 1986 [DE] Fed. Rep. of Germany ..... 3625375

[51] Int. Cl.[4] ..... F01P 7/02

[52] U.S. Cl. ..... 123/41.05; 123/41.12; 165/98

[58] Field of Search ..... 123/41.04, 41.05, 41.06, 123/41.58, 41.12; 165/98

[56] References Cited

U.S. PATENT DOCUMENTS

| | | | |
|---|---|---|---|
| 3,377,023 | 4/1968 | Costa et al. | 236/35 |
| 3,872,842 | 3/1975 | Medley | 123/41.58 X |
| 3,963,070 | 6/1976 | Alley et al. | 165/98 |
| 4,124,066 | 11/1978 | Taylor | 123/41.58 X |
| 4,133,185 | 1/1979 | Dickey | 62/179 |
| 4,186,694 | 2/1980 | Koseki | 123/41.58 X |
| 4,410,032 | 10/1983 | Mori | 123/41.58 X |
| 4,489,680 | 12/1984 | Spokas et al. | 123/41.05 |
| 4,854,459 | 12/1974 | Stimeling | 165/98 X |

FOREIGN PATENT DOCUMENTS

| | | |
|---|---|---|
| 1207710 | 12/1965 | Fed. Rep. of Germany . |
| 3043477 | 6/1981 | Fed. Rep. of Germany . |
| 3145506 | 5/1983 | Fed. Rep. of Germany . |
| 3211793 | 11/1985 | Fed. Rep. of Germany . |

OTHER PUBLICATIONS

"Automatishe Temperaturregelung in Kühlkreisläufen von Verbrennungsmotoren", Mtz, 20, vol. 5, May 1969, pp. 137–142.

*Primary Examiner*—Michael Koczo
*Assistant Examiner*—Richard R. Cole
*Attorney, Agent, or Firm*—Barnes & Thornburg

[57] ABSTRACT

To control the cooling air requirements of an internal combustion engine and additional assemblies on a motor vehicle, a combination of cooling air flaps adjustable by an electric motor and a ventilator blower whose rpm is adjustable and which are powered by electric motors is used. One closed, one partially open, and one fully open position of the cooling air flaps as well as the rotational speed of the blower are controlled as a function of the cooling requirements of the internal combustion engine and the states of an air conditioner, a temperature of an automatic transmission fluid, a temperature of an intake manifold of the internal combustion engine, and the position of an ignition switch and an engine hood contact switch in such fashion that a cooling air stream which changes nearly continuously with the cooling requirements is created in the cooling air duct. Advantageously, in addition to the optimum protection of the system and a favorable fuel consumption, a shortened warmup phase of the internal combustion engine and improved aerodynamics of the motor vehicle are achieved by limiting the throughflow of the internal combustion engine chamber with the cooling air flaps closed or partially open.

30 Claims, 4 Drawing Sheets xk=fkt(tm)
xk/%
100
xk2
30
xk1
0
xk0
75
tmg3
80
tmg1
85
tmg2
90
95
100
105
tm/°C ug=fgt(tm)
ug/V
ugmax
12
10
ug2
8
ug3
6
ug1
4
2
tmg5
tmg1
tmg2
tmg4 xk=fkp(p)
pg4
pg1
6
pg3
10
pg2
15
20
p/bar ug=fgp(p)
pg4
pg1
5
10
pg2
15
pg5
20
pg5p/bar FIG.7
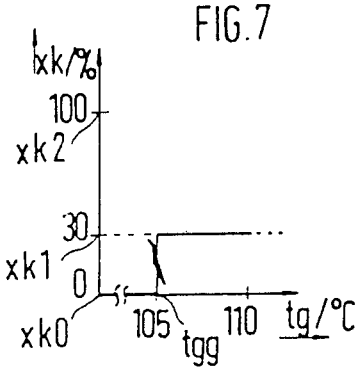
FIG.9
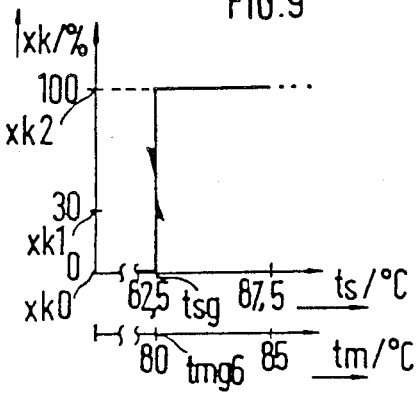
FIG.8
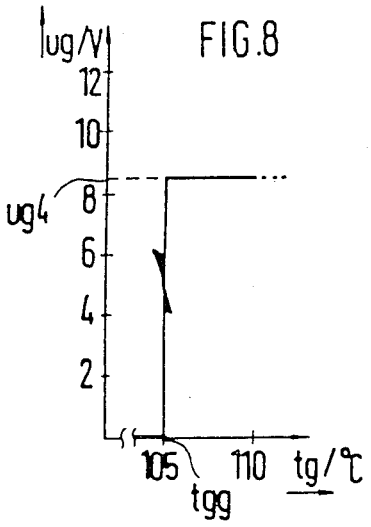
FIG.10
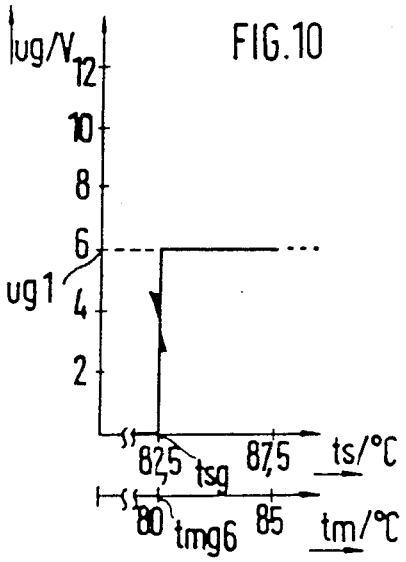
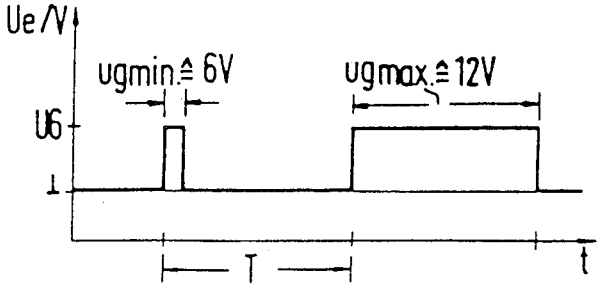
FIG.11

COOLING AIR FLAP AND BLOWER CONTROL FOR MOTOR VEHICLES

BACKGROUND AND SUMMARY OF THE INVENTION

The invention relates to a cooling air flap and blower control for motor vehicles, especially high performance passenger automobiles of the type having an engine radiator cooling air stream generated by movement of the vehicle, with controllable flaps for controlling the flow of air in response to certain vehicle operating conditions.

Recent developments in motor vehicles, especially automobiles, in very recent times have increasingly reflected the standpoint of optimal aerodynamic design, especially to increase driving performance and reduce fuel consumption. One important factor in this regard is the throughflow required through the engine compartment to cool the engine, which has a negative effect on the so-called coefficient of air resistance. It is also desirable for the engine, following a starting procedure from the cold state, to warm up rapidly to an operating temperature at which it can operate with optimum economy and service life, and to keep the latter as constant as possible during operation.

German OS No. 32 11 793 teaches a coolant temperature regulatinig system for a motor vehicle engine which, in addition to the conventional coolant temperature regulation using a thermostat in a bypasss circuit for the coolant for the engine and the cooling air blower which is switched on and off by a thermostat, additionally controls a shutter in an opening in the car body through which cooling air flows.

It is true that this deals with the requirement to improve aerodynamics. However, the controlling elements used all exhibit more or less of a two-point characteristic so that the operating temperature of the engine cannot be kept constant at a required level. The resulting constant fluctuations around a set operating point produce a poor quality of regulation and hence load and wear on the engine, including all the assemblies and parts traversed by the cooling water. In addition, the adjusting element of the shutter, which is designed as an element made of expanding material and is affected only by the coolant, cannot be set sufficiently accurately and permits no additional parameters to adjust the cooling air stream to the cooling air needs of the engine and auxiliary or additional assemblies.

To improve the quality of regulation, combined regulating systems with continually operating adjusting elements have been proposed "Motortechnische Zeitschrift", Volume 20, No. 5, May 1959, pages 141 to 142. These hydraulically or hydrostatically operating systems however, are extremely cumbersome and expensive; their use is admissible only when the internal combustion engine already has a pressurized oil supply. Another problem is the compressed oil leaks which are always present in hydraulic or hydrostatic systems.

U.S. Pat. No. 4,133,185, to Robert B. Dickey, relates to an automatic air circulation control, including air inflow shutters. U.S. Pat. No. 4,546,742, to Fred D. Sturges, also discloses controllable radiator shutters in a temperature control system for internal combustion engines.

An object of the invention is to provide an improved coolant and blower control for motor vehicles which optimally regulates the temperature environment of an internal combustion engine including its auxiliary and additional assemblies of acceptable cost and also fully takes into account the aerodynamic aspects of the motor vehicle.

The advantages of the invention lie primarily in the fact that a cooling air flap and blower control for motor vehicles is provided which controls the cooling air requirements of an internal combustion engine of a motor vehicle including all auxiliary and additional assemblies with outstanding quality control. In addition, it is readily adjustable to varying conditions in different types of motor vehicles in internal combustion engines, requires only a small amount of room for installation, and is inexpensive to manufacture and install.

Further objects, features, and advantages of the present invention will become more apparent from the following description when taken with the accompanying drawings(s) which show, for purposes of illustration only, an embodiment/several embodiments in accordance with the present invention.

BRIEF DESCRIPTION OF THE DRAWINGS

FIG. 7 is a graph similar to FIG. 3, but for the positioning of the cooling air flaps as a function of the temperature of a lubricant of a transmission;

FIG. 8 is a graph similar to FIG. 3, but for the blower;

FIG. 9 is a graph similar to FIG. 3, but for positioning the cooling air flaps as a function of the temperature of an intake manifold or coolant circuit when the internal combustion engine is shut off;

FIG. 10 is a graph similar to FIG. 9, but for the blower; and

FIG. 11 is a graph showing voltage as a function of time for a scanning ratio of the arrangement of the present invention.

DETAILED DESCRIPTION OF THE DRAWINGS

Figure 1:
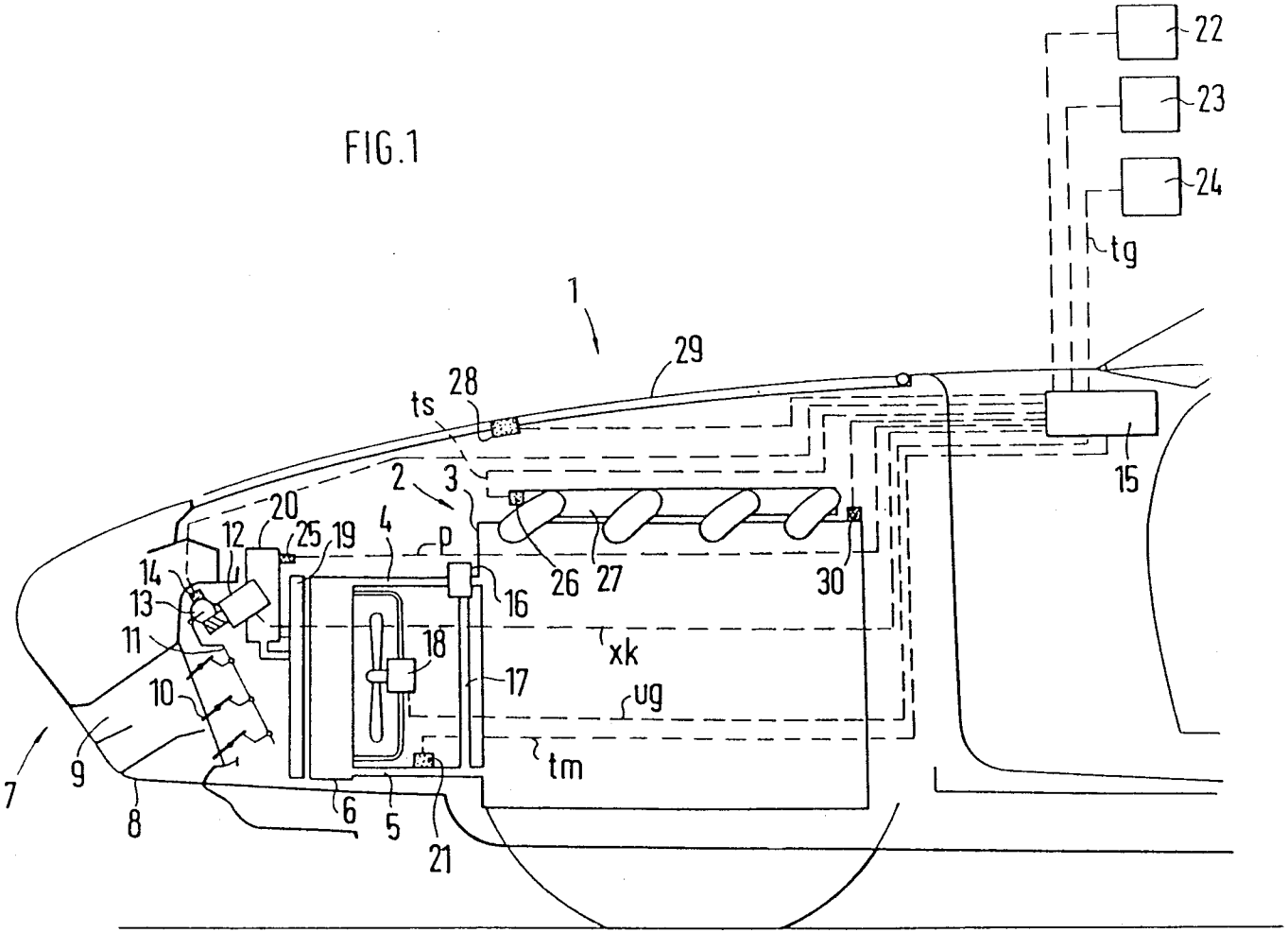
FIG. 1 is a cross sectional view through the engine compartment of a motor vehicle schematically depicting a cooling air flap and blower control arrangement constructed in accordance with a preferred embodiment of the invention.

In FIG. 1, a motor vehicle is schematically depicted wherein in the forward portion or engine compartment 2 an internal combustion engine 3 is located in the forward portion or engine compartment 2. The engine 3 is connected by coolant lines (supply 4, return 5) with a heat exchanger (liquid radiator 6), which can be exposed to the head wind through an opening in the body 7 in the nose 8 of a vehicle and a cooling air duct 9.

Cooling air duct 9 is openable and closable by means of cooling air flaps 10 whose positions are controllable.

Cooling air flaps 10 are controlled via control rod 11 (crank drive) by an electric motor 12 with flanged drive 13. A control disk 14 is nonrotatably mounted on a transmission output shaft (not shown), by means of which disk, cooling air flaps 10 can be controlled to assume a closed position (xk=0%), a partially open position (xk=30%), and a completely open position (xk=100%). Control disk 14 and electric motor 12 are connected to a control device 15 for this purpose by means of a relay which will be discussed in greater detail below.

It should be pointed out that the connections represented by dashed lines in FIG. 1 between the individual assemblies merely represent symbolic operating connections which provide no detailed information about the nature and number of the electrical leads installed (signal leads, power supply leads). The latter are apparent to an individual skilled in the air by virtue of the structural characteristics of the devices employed and described herein.

In addition, a conventional thermostatic valve 16 is shown in coolant circuit 4, 5, 6 of internal combustion engine 3, said valve short-circuiting the coolant path via a bypass line 17 during the warmup phase of internal combustion engine 3.

A blower 18 driven by an electric motor is disposed between heat exchanger 6 and internal combustion engine 3, by means of which blower, heat exchanger 6, internal combustion engine 3, and a condenser 19 of an air conditioner 20 shown schematically (said condenser being located upstream of the heat exchanger looking in the direction of travel) can be subjected to a flow of forced air (additional heat exchangers can also be provided in the cooling air stream, for example a boost air radiator or a radiator for a fluid circuit of an automatic transmission, next to, above, or behind one another).

The rotational speed of blower 18 is continuously adjustable by means of control device 15 and an electronic end stage, shown later. One parameter for controlling the blower rpm and cooling air flap position is a temperature tm (coolant temperature) of internal combustion engine 3 which is detected by means of a coolant temperature sensor 21 in return 5 of coolant circuit 4 to 6.

In addition to the coolant temperature tm, other parameters are involved in the control system. Control device 15 receives signals from an ignition switch 22 (ignition on or off), an air conditioner switch 23 (air conditioner on/off), a temperature sensor 24 (temperature switch) in the liquid circuit of the automatic transmission, a pressure sensor 25 in a coolant circuit of air conditioner 20, a temperature sensor 26 (temperature switch) in or on intake manifold 27 of internal combustion engine 3 and a hood contact switch 28 which monitors the closed position of motor hood 29 to lock engine compartment 2. Finally, an excess temperature switch 30 can be connected to control device 15 to monitor the temperature of the engine at its cylinder block or head and preferably turn on a warning light on the dashboard of the motor vehicle directly and/or indirectly via a central processing unit (to display danger situations; not shown here).

Figure 2:
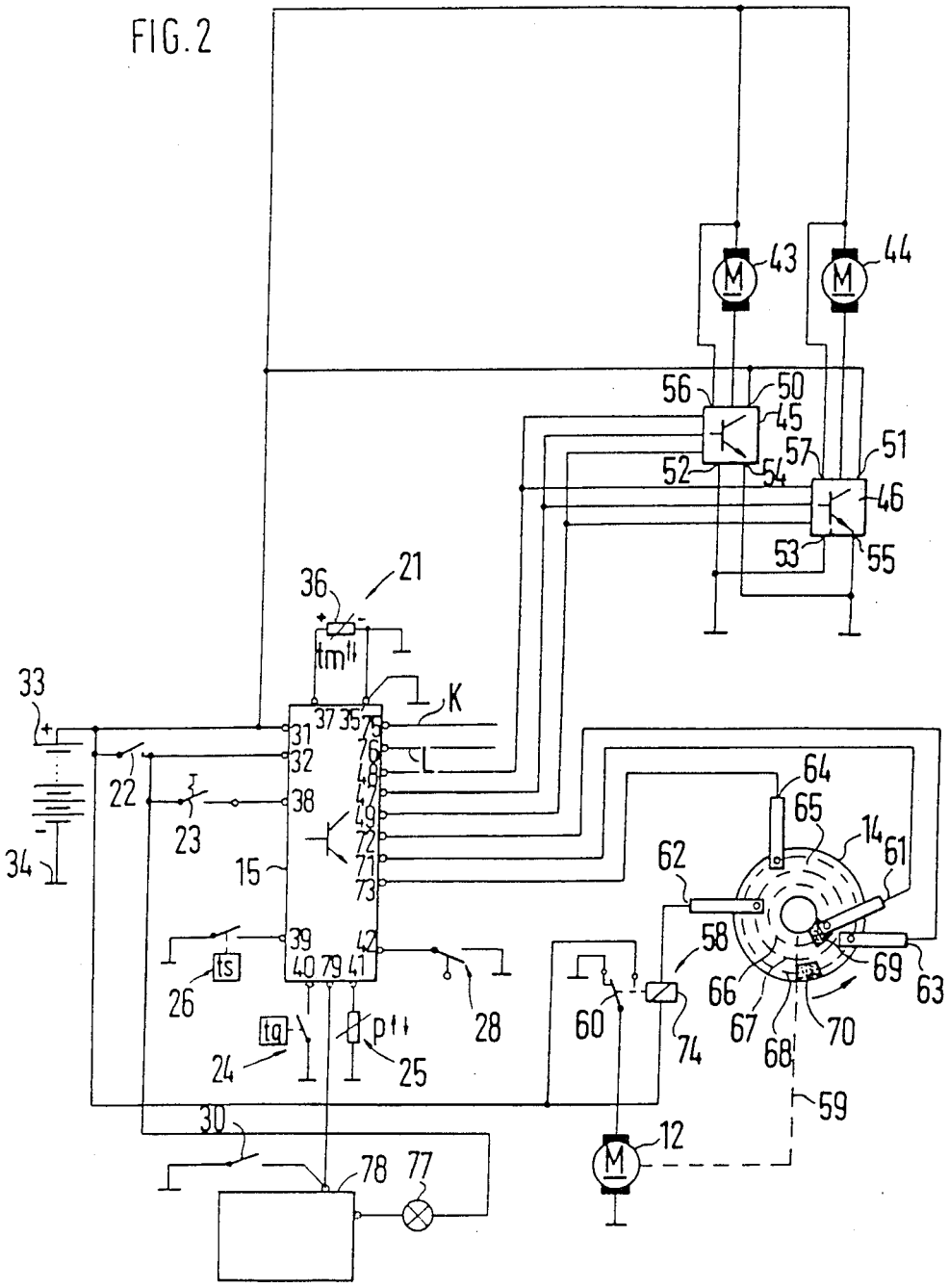
FIG. 2 is a schematic diagram of the circuit for controlling the cooling air flap and blower control arrangement of FIG. 1.

The electrical connections between the individual elements can be seen in the circuit in FIG. 2. Control device 15 is connected directly via an input 31 and indirectly via an input 32 via ignition switch 22 with the positive terminal (+) of a battery 33, whose negative terminal (−) is connected to the vehicle ground 34; control device 15 is connected to the latter by means of an input 35.

The coolant temperature sensor 21 is an NTC resistor 36 connected to inputs 35 and 37. Signals from air conditioner switch 23, temperature sensor 26 on the intake manifold (temperature limit switch) and temperature sensor 24 in the fluid circuit of the automatic transmission (temperature limit switch) reach control unit 15 via inputs 38 to 40.

A signal from pressure sensor 25 in the coolant circuit of the air conditioner is connected to an input 41; this sensor is designed as a continuously operating pressure sensor. Finally an input 42 is connected with hood contact switch 28.

The fan blower, driven by an electric motor, is installed in the circuit as a dual electric fan with two drive motors 43 and 44 and electronic end stages 45, 46 which is done, as far as the end stages are concerned, for redundancy purposes and, as far as the electric fans are concerned, for reasons of improved spatial arrangement. Of course the functional reliability of the circuit is ensured even with a simple design.

A drive motor 43, 44 and an electronic end stage 45, 46 are connected in series and connected in parallel to the load power supply; end stages 45 and 46 are likewise connected in parallel on the control side.

The electronic end stages 45, 46 preferably receives a release signal, via an output 47 of control device 15 in certain embodiments which may also be deleted.

Electronic end stages 45, 46, which are designed in the form of semiconductor switches, obtain a scannnng ratio via an output 48 of control device 15 in the form of a pulse-wide-modulated square-wave signal. The blower control can also be designed so that the scanning ratio is generated in electronic end stages 45, 46 and control device 15 generates only a corresponding analog or digital signal.

Finally, a return line runs from electronic end stages 45, 46 to an input 49 of control device 15, via which a signal can be delivered to the latter to indicate whether an error exists in the supply circuit to the end stage (short circuit, lead broken) or whether it is defective. Finally, the electronic end stages also have connections for an operating power supply (positive terminal 50, 51, ground 52, 53) for the electronics, ground 54, 55 for the supply circuit (semiconductor switches) and one output 56, 57 each for a free-running diode integrated into the end stage but not shown.

Electric motor 12, which serves to drive the cooling air flaps and is provided with the drive is controlled by control unit 15 via a relay 58 and control disk 14 which is nonrotatably connected with a (symbolically shown) output shaft 59 of transmission 13. Electric motor 12 has one of its terminals connected to ground; the other terminal is supplied via a moving contact 60 of relay 50 in the controlled state with the positive terminal (+) and hence with operating voltage. In the noncontrolled state, moving contact 60 is connected to ground, so that the armature winding of motor 12 is short-circuited and a braking action is achieved. Sliding contacts 60 to 64, which are mounted in a fixed manner, have a frictional connection with control disk 14 which is made circular; control disk 14 has a circular contact path 65 with which the first sliding contact 61 is in electrically conducting contact on an inner path 66, the second sliding contact 62 is in contact on a middle path 67, and the third and fourth sliding contacts 63 and 64 are in contact on an outer path 68. In the area of the inner (66) and outer (68) circular paths of contact path 65, an insulating surface 69, 70, which becomes effective within a limited rotational angle range, is located which interrupts the electrical connection between contact path 65 and the first 61, third 63, and fourth 64 sliding contacts.

The first, third, and fourth sliding contacts 61, 63, 64 are connected with outputs 71, 72, 73 of control device 15, by which the cooling air flaps can be controlled to assume a closed (xk0=0%), partially open (xk1=30%), and fully open (xk2=100%) position xk. The second sliding contact 62 is in the exciting circuit of relay 58, whose exciting winding 74 is connected on one side permanently to the positive terminal (+) of battery 33.

The functioning of the system is explained as follows:

Starting with the position shown, in which the cooling air flaps are closed, we will presume for example, that the partially open position is to be assumed. Control device 15 for this purpose connects output 72 to ground potential which is transmitted by third sliding contact 63 via contact path 65 to second sliding contact 62, so that exciting winding 74 of relay 58 is connected on one side to ground and on the other side to the positive terminal (+). Relay 58 pulls in, whereupon electric motor 12 and control disk 14 with it (and of course the cooling air flaps as well) are set in motion (rotary motion counterclockwise). The rotary motion is continued until insulating area 70 assumes an angular position in which fixed third sliding contact 63 is located; here it breaks the conducting link between third sliding contact 63 and contact strip 65 so that relay 74 drops out and the motor is braked to a stop. The fully open position and the closed position are reached by appropriately controlling the first 61 and fourth 64 sliding contacts. The adjustment from one position to another as a result of the fixed single direction of rotation is always in the following sequence: closed—partially open-fully open—closed.

The control of the individual positions is subject to time limitations: it is designed so that it is just sufficient for each adjustment process under the most difficult conditions. In this way, overloads on the drive are avoided and it is also possible to eliminate any need for position feedback.

Control device 15, which preferably uses known microcomputer technology, can also be made capable of self-diagnosis and may include an electrically erasable memory area in which error messages from the microcomputer can be stored; as described, for example, in German OS No. 35 40 599, these messages can be called up in a diagnostic process by a diagnostic system.

The control device is connected for this purpose via inputs/outputs 75, 76 with a communications lead K and an exciting lead L. Provision is also made for the fact that when an emergency function triggered for example by the failure of a sensor, appears, a warning light 77 is triggered on the control panel of the motor vehicle by a central processing unit 78, which obtains a signal via an output 79 of the control unit. When the emergency function cuts in, the flaps are simultaneously completely opened and the blower is run at maximum rpm. In addition, a position feedback can be provided by sliding contacts 61 to 64 and warning light 77 can be triggered if desired.

The function of the cooling air flap and blower control will now be described with reference to the graphs in FIGS. 3 to 10.

Figures 3, 4, 5, 6:
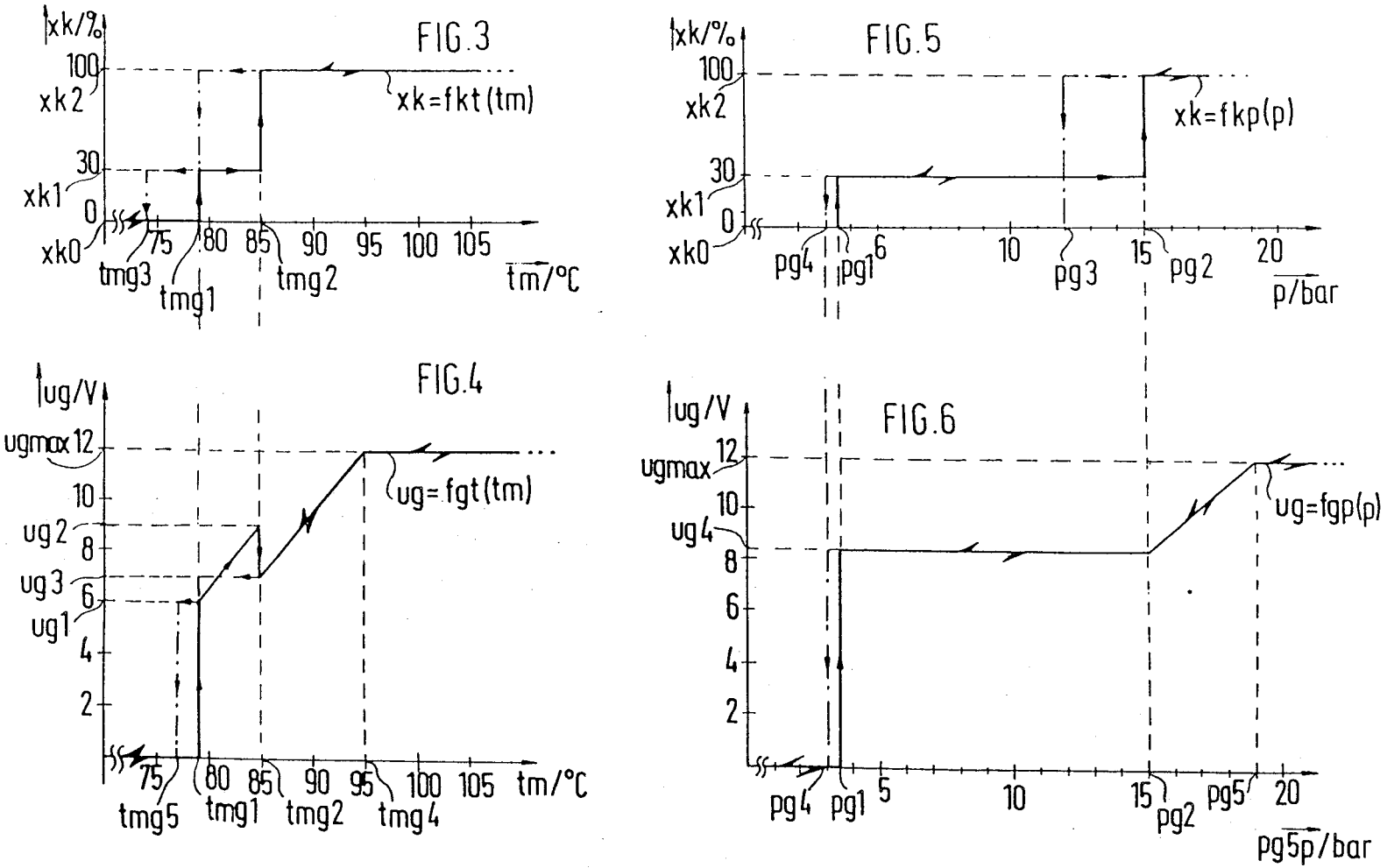
FIG. 3 is a graph showing a control function for positioning cooling air flaps as a function of temperature in the coolant circuit of an internal combustion engine according to a preferred arrangement of the presention invention.
FIG. 4 is a graph similar to FIG. 3, but for a blower.
FIG. 5 is a graph similar to FIG. 3, but for a control function for positioning cooling air flaps as a function of pressure in a coolant circuit of an air-conditioner.
FIG. 6 is a graph similar to FIG. 5, but for a blower.

FIG. 3 initially shows the dependence xk=fkt(tm) of the cooling air flap position xk on engine temperature tm. Flap position xk is expressed as a percentage with value xk0=0% corresponding to the closed position, the value xk1=30% of the partially open position, and the value xk2=100% to the fully open position. The engine temperature here is expressed in degrees Centigrade (°C.).

With rising engine temperature values tm, the cooling air flaps initially remain closed until a first temperature threshold tmg1 is reached, which here would be assumed to be 79° C. Above this threshold value, flaps 10 will be moved into the partially open position xk1 for constantly rising values of engine temperature tm, which position is retained until a second temperature threshold tmg2 is reached. Above this second temperature threshold tmg2, which here we will assume to be 85°, the flaps will be fully opened. If the engine temperature tm drops again, the cooling air flaps will remain in the fully open position xk2 until the first temperature threshold tmg1 is reached, and then move into their partially open position xk1. This in turn is retained down to a third temperature threshold tmg3 (assumed to be 74° C.) and the closed position xk0 will be triggered as the temperature continues to fall below tmg3.

FIG. 4 shows the relationship $\mu g$=fgt(tm) of the scanning ratio to the control of fan blower 18, 43, 44 as a function of engine temperature tm. However, it is not the scanning ratio itself which is plotted on the ordinate of the graph as the controlling value but the voltage $\mu g$, scaled in volts, which appears at the terminals of the fan at a certain scanning ratio. Up to a first temperature threshold tmg1 the blowers are operated for increasing values of engine temperature tm up to the second temperature threshold tmg1 with a voltage $\mu g$ which increases linearly with temperature from $\mu g$1=6 volts to $\mu g$2=9 volts. When the second temperature threshold tmg2 is reached, voltage $\mu g$ is lowered from $\mu g$2=9 volts to $\mu g$3=7 volts, to be raised to the full onboard line voltage of $\mu g$ max=12 volts at higher values of the engine temperature tm up to a fourth temperature threshold tmg4; above this value the control voltage of $\mu g$ max=12 volt is retained.

For falling temperatures, the control curve initially runs downward to the second temperature threshold tmg2 equivalent to that for rising temperatures. Below the second temperature threshold tmg2 the voltage $\mu g$3=7 volts is maintained down to the first temperature threshold tmg1 and when the first temperature threshold is reached, it drops to $\mu g$1 =6 volts. This control is maintained down to a fifth temperature threshold tmg5 (at 77° C.) Below the fifth temperature threshold tmg 5, the blower is no longer controlled to operate.

The special nature of the control curve shown in FIG. 4 lies in the fact that the voltage $\mu g$ for controlling the blowers is lowered by approximately 2 volts precisely when the cooling air flaps are moved from their partially open position xk1=30% to their fully open position xk2=100%. The lowering of the blower voltage $\mu g$ and the resultant lowering of the blower rpm means that in the temperature interval between first temperature threshold tmg1 and fourth temperature threshold tmg4, despite the intermediate opening of the cooling air flaps by about 70%, a cooling air stream which increases continuously with engine temperature tm is obtained in the cooling air duct. By avoiding a cooling air stream that changes abruptly, a good regulating behavior is obtained and continuous switching back and forth between the partially and fully open cooling air flap positions is avoided.

Finally, FIG. 5 shows a control curve (xk=fkp(p)), which shows the cooling air flap position xk in percent as a function of pressure p of the coolant in the air conditioner (measured in bars). Above a first pressure threshold pgl of about 3.5 bars the flaps are moved into partially open position xk1. This position is maintained up to a second pressure threshold pg2 at about 15 bars and raised to 100% for higher pressures p. If pressure p drops off again, the cooling air flap position xk will remain at 100% up to a third pressure threshold pg3 (12 bars) and is then adjusted to 30% down to a fourth pressure threshold pg4 (3 bars). Below the fourth pressure threshold value pg4, which is at about 3 bars, the flaps remain closed.

FIG. 6 again shows the voltage $\mu g$ (in volts) of the blower as a function $\mu g = fgp(p)$ of pressure p. For rising pressures, the blower is initially not controlled up to a first pressured threshold pgl. Above pressure threshold pgl and up to a second pressure threshold pg2, control is accomplished with a voltage $\mu g4$ of about 8.5 volts, which is raised above the second pressure threshold pg2 up to a fifth pressure threshold pg5 (at about 19 bars) linearly up to the maximum onboard line voltage of $\mu g$ max=12 volts; here it remains for higher pressures p. For falling pressures p the control curve $\mu g = fgp(p)$ runs parallel with that for rising pressures and remains at a voltage of $\mu g4 = 8.5$ volts down to below the first pressure threshold pg1. Below a fourth pressure threshold pg4 at about 3 bars the blower is switched off once again.

FIGS. 5 and 6 also show hysteresis characteristics which serve primarily to smooth the flap control. It should be pointed out at this juncture that the control curves shown in FIGS. 3 to 6 are effective only when the ignition is switched on; likewise control according to FIGS. 5 and 6 as a function of pressure p is provided only when the air conditioner switch is actuated.

In the preferred illustrated embodiment the control of the fan flaps or blower always produces the same control curves (shown in FIGS. 3 to 6) which momentarily imply the highest control value; i.e., whenever any control variable would indicate a higher control value, that higher control value is implemented.

FIGS. 7 to 10 show additional control curves for the flap position or blower. The control curves shown in FIGS. 7 and 8 are active only when the ignition is switched on while the control curves in FIGS. 9 and 10 are effective only when internal combustion engine 2 is switched off; the fan blower shown in FIG. 10 is controlled only when engine hood 29 is closed.

In FIGS. 7 and 8 the cooling air flap position xk and blower voltage $\mu g$ are displayed as a function of the temperature tg of the lubricant in the transmission. Below a temperature tgg of 105° there is no control of the ventilation flaps or blower. For temperature values tg higher than or equal to tgg=105° C. the cooling air flaps are controlled in their partially open position xk1 and the blower is operated with a voltage $\mu g4$ of about 8.5 volts. According to FIG. 9, the cooling air flaps, with the engine shut off, are fully opened xk2—100% only when either the temperature ts in the internal combustion engine intake manifold is above a temperature threshold tsg of 82.5° C. or the temperature of the internal combustion engine rises above a temperature threshold tmg6 of 80° C. In addition, according to FIG. 10, the fan blower is operated with a voltage $\mu g$ of $\mu g1 = 6$ volts above these temperature thresholds tsg, tmg6 of ts or tm with engine hood 29 closed. However, it is also contemplated in certain embodiments not to control cooling air flaps 10 according to FIG. 9 when internal combustion engine 3 is shut off, but always to keep them fully open.

Finally, FIG. 11 shows examples of a scanning ratio signal in a graph showing voltage as a function of time, as used to control electronic end stages 45, 46. One minimum and one maximum scanning ratio signal are shown, each of which corresponds to an equivalent DC voltage drop at the terminals of the blower of 6 volts and 12 volts. The maximum onboard line voltage is assumed here to be 12 volts; but in the case of motor vehicles equipped with lead storage batteries, it can also be 13.2 volts. It should also be pointed out at this juncture that the two end stages 45, 46 are scanned, staggered one half scanning period apart, so that the noise voltage load scan also be kept low.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A cooling air control system for motor vehicles of the type having cooling air duct means opening to an engine copartment, comprising:

controllable cooling airflap means for controlling the size of the flow opening in the cooling air duct means;

controllable speed fan means for controlling the flow of air supplied by the cooling air duct means;

electric motor driven airflap control means for controlling the airflap means in response to detected cooling air requirements to selectively move the same; to a closed position, a partially open position or a fully open position; and rotational speed control means for controlling the rotational speed of the fan means in response to detected cooling air requirements starting in the partially open position of said airflap means.

2. A system according to claim 1, further comprising cooling air requirement detecting means for detecting cooling air requirements.

3. A system according to claim 2, wherein said cooling air requirement detecting means includes means for detecting at least two of (i) engine coolant temperature; (ii) air conditioner refrigerant pressures; (iii) vehicle transmission fluid temperature; and (iv) vehicle engine intake manifold temperature.

4. Cooling air flap and blower control for motor vehicles whose engine compartment is exposable to a cooling air stream by at least one opening terminating in a cooling air duct in the body, whereby the cooling air duct is closable by cooling air flaps whose position can be controlled and at least one heat exchanger and at least one blower with a controllable rotational speed (rpm) are disposed in the cooling air duct, and the position of the cooling air flaps and the rpm of the blower are controllable by a contorl means as a function of a cooling requirement of systems of the motor vehicle such that when the cooling requirement increases the cooling air flaps are intially moved into an open position and as the cooling air requirement rises further, the blower is additionally controlled, wherein said control means controls an electric motor to move said cooling air flaps, depending on the cooling requirements, to a closed position (zk=kz0), a partially open position (sk—zk2) and a fully open position, and controls the rpm of said blower, starting in the partially open position of said cooling air flaps so that a cooling air stream which changes approximately continuously proportionally with the cooling requirements is obtained in a cooling air duct.

5. Cooling air flap and blower control according to claim 4, wherein the cooling requirements are derived from at least one of the following values:

temperature (tm) of a coolant in an internal combustion engine;

pressure (p) in a coolant circuit of an air conditioner; and temperature (ts) of an intake manifold of the internal combustion engine, whereby when the cooling requirement is determined by more than one value, that value is used for control which implies the highest controlling value (xk, μg) for cooling air flaps or blower.

6. Cooling air flap and blower control according to claim 5, wherien said control means includes control curves (xk=fkt(tm), xk=fkp(p), μg=fgt(tm), μg=fgp(p)), which have hysteresis defining:

cooling air flap adjustment (xk0 as a function of temperature (tm) or pressure (p); and motor drive voltage value (μg) set by a scanning ratio to control blower as a function of temperature (tm) and/or pressure (p) and the voltage values (μg) which increase of themselves along with the independent variables, (tm), at least in control curve (μg=fgt(tm)), are lowered by a certain amount at that temperature (tm) at which cooling air flaps swivel from partially open position (sk1) to fully open position (xk2).

7. Cooling air flap and blower control according to claim 6, wherein some control curves (xk=fkt(tm), xk=fkp+(p), μg=fgt(tm), μg=(FGP(p)) are effective only when the ignition is switched on and some control curves (xk=fkp(p), μg=fgp(p)) are effective only when air conditioner is switched on.

8. Cooling air flap and blower control according to claim 7, wherein cooling air flaps (10) are fully open when ignition is switched off.

9. Cooling air flap and blower control according to claim 8, wherein one of said control curves (xk=fkt(tm))13 with rising temperature;

assumes a value (xk=xk0) for the closed position (xk0) of cooling air flaps as long as temperature (tm) is less than a first temperature threshold (tmg1);

assumes a value (xk=xk1) for the partially open position as long as temperature (tm) is greater than or equal to first temperature threshold (tmg1), but is still below a second temperature threshold (tmg2);

with dropping temPerature (tm), remains at this control value (xk=xk2) as long as temperature (tm) has not yet fallen to first temperature threshold (tmg1); and beyond this value, assumes the value (xk=xk1) for the partially open position (xk1) as long as temperature (tm) has not yet dropped to a third temperature threshold (tmg3), and beyond this value, assumes the value (xk=xk0) for the closed position.

10. Cooling air flap and blower control according to claim 9, wherein one of said control curves (μg=fgt(tm));—with rising temperature (tm)

produces no control of blower as long as temperature (tm) remains below first temperature threshold (tmg1);

assumes a voltage value (μg) which increases linearly between first voltage value (μg1) and a second voltage value (μg2) so long as temperature (tm) is higher than or equal to first threshold (tmg1), but is still below second temperature threshold (tmg2);

on reaching second temperature threshold (tmg2), at which cooling air flaps swivel from the partially open into the fully open position, lowers the voltage (μg) to a third voltage value (μg3), whereby when temperature (tm) increases further, the voltage (μg) is increased linearly until it reaches a value (μg. max.) for the maximum onboard line voltage when a fourth temperature threshold (tmg4) is reached, and retains the latter;—with falling temperature (tm)

starting at a value of temperature (tm) above fourth temperature threshold (tmg4);

initially moves following the same curve until it reaches a second temperature threshold (tmg2);

then remains at third voltage value (μg3) between second temperature threshold (tmg2) and first temperature threshold (tmg1);

on reaching first temperature threshold (tmg1) lowers the voltage value (μg) to the first voltage value (μg1), at which it remains until it drops to a fifth temperature threshold (tmg5) beyond which no further control of blower is effected.

11. Cooling air flap and blower control according to claim 10, wherein one of said control curves (xk=fkp(p))—with rising pressure (p);

for pressure values (p) is lower than a first pressure threshold (pg1) at the value (xk0) for the closed position of the cooling air flaps, for pressure values (p) is above or equal to first pressure threshold (pg1), but below a second pressure threshold (pg2) at value (xk1) for the partially open position of the cooling air flaps and for pressure values (p) is higher than second pressure threshold (pg2) at the value (xk2) for the fully open position of cooling air flaps, and—for falling values of pressure (p);

from a value above second pressure threshold (pg2) down to a third pressure threshold (pg3) located below second pressure threshold (pg2), remains at value (xk2), for pressure values (p) below or equal to the third pressure threshold (pg3), but higher than a fourth pressure threshold (pg4) located below first pressure threshold (pg1), is at value (xk1) and for pressure values (p) below or equal to fourth pressure threshold (pg4) is at value (xk0) for cooling air flaps.

12. Cooling air flap and blower control according to claim 11, wherein one of said control curves (μg=fgp(p))—with rising pressure (p);

for pressure values (p) below a first pressure threshold (pg1) causes no control of blower;

for pressure values (p) above or equal to first pressure threshold (pg1), but below or equal to second pressure threshold (pg2), runs at a fourth pressure value (μg4);

for pressure values (p) above or equal to second pressure threshold (pg2), but below or equal to a fifth pressure threshold (pg5) located above second pressure threshold (pg2) increases linearly from fourth voltage value (μg4) up to voltage value (μg max.), and remains at this level for even higher values;—for falling values (p)

down to first pressure threshold (pgl), runs on the same curve as for rising pressure values (p) and for pressure values below or equal to first pressure threshold (pg1) but higher than fourth pressure threshold (pg4) remains at fourth voltage value (μg4) and for group values (p) below or equal to fourth pressure threshold (Pg4) produces no control of blower.

13. Cooling air flap and blower control according to claim 12, wherein cooling air flaps are controlled from closed position (xk0) to partially open position (xk1) so long as ignition is switched on and the temperature (tg) of the lubricant in the fluid circuit of the automatic transmission reaches or exceeds a temperature threshold (tgg).

14. Cooling air flap and blower control according to claim 13, wherein blower is energized starting from the noncontrolled state (μg=0), with fourth voltage value (μg4) as soon as ignition is switched on and the temperature (tg) of the lubricant in the fluid circuit of the transmission reaches or exceeds a temperature threshold (tgg).

15. Cooling air flap and blower control according to claim 14, wherein cooling air flaps are controlled from closed position (xk0) to fully open position (xk2) as soon as ignition is turned off, an engine hood is closed, and the temperature (tm) of internal combustion engine reaches or exceeds a sixth temperature threshold (tm6) and/or the temperature (ts) of intake manifold of internal combustion engine reaches or exceeds a temperature threshold (tsg).

16. Cooling air flap and blower control according to claim 15, wherein blower is energized from the noncontrolled state (μg=0) with first voltage value (μg4), as soon as ignition is switched off, engine hood is closed, and temperature (tm) of internal combustion engine reaches or exceeds sixth temperature threshold (tmg6) and/or temperature (ts) of intake manifold of internal combustion engine reaches or exceeds a temperature threshold (tsg).

17. Cooling air flap and blower control according to claim 16, wherein an electric motor provided with a transmission for actuating cooling air flaps on its transmission output shaft moves a control disk in a nonrotatable fashion for controlling electric motor cooling air flap actuating [system] into its closed (xk0), partially open (xk1) and fully open (xk2) positions (xk), whereupon electric motor is connected with or insulated from a power supply by means of a relay, whose exciting circuit on the one hand is permanently connected to a first terminal (+) of a power supply and on the other hand is connected by a control device by sliding contacts frictionally connected with control disk to a second terminal (negative terminal (−)) of a power supply.

18. Cooling air flap and blower control according to claim 17, wherein control disk is made circular and has a contact part in the form of a circular ring by means of which a first sliding contact enters into an electrically conducting active relationship on an inner circular path, a second sliding contact into a middle circular path and a third and fourth sliding contact into an outer circular path, whereupon an insulating surface, which breaks the electrical operating connection in a limited rotational angle range, is disposed on the inner and outer circular paths and second sliding contact is in the exciting circuit of relay and the first, third, and fourth sliding contacts are connected with a first, second, and third output of the control device which serves to control relay and actuate the cooling air flaps into the closed (xk0) partially open (xk1) and fully open (xk2) positions.

19. Cooling air flap and blower control according to claim 18, wherein the control of the individual cooling air flap positions (xk1, i=0, 1, 2) is subjected to a time limitation, so designed that it is at least sufficient for each adjustment process under difficult conditions.

20. Cooling air flap and blower control according to claim 19, wherein a relay short-circuits said electric motor in the non-excited state.

21. Cooling air flap and blower control according to claim 20, wherein said blower rpm is controlled by a semiconductor switch which is controlled by said control means by a pulse-width-modulated square-wave signal.

22. Cooling air flap and blower control according to claim 20, wherein said control means provide an analog or digital signal to an end stage which converts the latter into a scanning ratio signal to control a semiconductor switch.

23. Cooling air flap and blower control according to claim 22, wherein control means obtains input signals from a cooling water temperature sensor which determines the coolant temperature (tm) of internal combustion engine (3), a temperature sensor which determines the temperature (ts) on the intake manifold of the internal combustion engine, a hood contact switch which senses the closed position of the flap for sealing engine compartment, and/or a temperature sensor which senses the temperature (tg) of the lubricant of a transmission and/or a pressure sensor in the coolant circuit of an air conditioner and/or a switch for switching the air conditioner on and off and/or a feedback signal indicating the functioning of the blower or semiconductor switch from the end stage and/or a signal from an ignition switch and, as a function thereof, controls three cooling air flap positions (xk0, xk1, xk2) and electronic end stage.

24. Cooling air flap and blower control according to claim 23, wherein the control means monitors and checks itself as well as the connected sensors for their function and checks whether the cooling air flaps have reached their set positions and, if there is a malfunction, initiates emergency functions and stores an error code in a memory area (error memory).

25. Cooling air flap and blower control according to claim 24, wherein when ignition is switched off and hood is open, a safety circuit becomes effective which avoids uncontrolled starting of blower.

26. Cooling air flap and blower control according to claim 25, wherein said control means is capable of diagnosis and has a memory area from which a diagnostic system can read diagnostic data by a diagnostic bus (K, L).

27. Cooling air flap and blower control according to claim 26, wherein said control means triggers a warning lamp in the event of a system defect by an error report line.

28. Cooling air flap and blower control according to claim 27, wherein the blower can continue running only for a limited space of time after ignition is switched off.

29. Cooling air flap and blower control according to claim 28, wherein said control means includes a microprocessor.

30. Cooling air flap and blower control according to claim 29, wherein the two electronic end stages are pulsed staggered one half period apart.

* * * * *